US012669258B2

(12) United States Patent
Huang et al.

(10) Patent No.: US 12,669,258 B2
(45) Date of Patent: Jun. 30, 2026

(54) CONTROL DEVICE AND AIR CONDITIONER WITH SIMPLIFIED INSTALLATION COMPLEXITY

(71) Applicants: Hangzhou Sanhua Research Institute Co., LTD., Hangzhou City (CN); Hangzhou Leaderway Electronics Co., LTD., Hangzhou City (CN)

(72) Inventors: Longzhong Huang, Hangzhou City (CN); Jie Bai, Hangzhou City (CN); Guoqiang Zhang, Hangzhou City (CN); Dezhi Cheng, Hangzhou City (CN); Wenming Run, Hangzhou City (CN); Chenglin Lin, Hangzhou City (CN); Yongsong Lv, Hangzhou City (CN); Jiajun Zhang, Hangzhou City (CN); Qihong Jin, Hangzhou City (CN); Linjie Huang, Coconut Creek, FL (US)

(73) Assignees: HANGZHOU SANHUA RESEARCH INSTITUTE CO., LTD., Hangzhou City (CN); HANGZHOU LEADERWAY ELECTRONICS CO., LTD., Hangzhou City (CN)

( * ) Notice: Subject to any disclaimer, the term of this patent is extended or adjusted under 35 U.S.C. 154(b) by 342 days.

(21) Appl. No.: 18/274,459

(22) PCT Filed: Feb. 14, 2022

(86) PCT No.: PCT/CN2022/076130
§ 371 (c)(1),
(2) Date: Jul. 26, 2023

(87) PCT Pub. No.: WO2023/097890
PCT Pub. Date: Jun. 8, 2023

(65) Prior Publication Data

US 2025/0347438 A1 Nov. 13, 2025

(30) Foreign Application Priority Data

Nov. 30, 2021 (CN) ..... 202111448185.9

(51) Int. Cl.
*F24F 11/88* (2018.01)
*F24F 11/36* (2018.01)
(Continued)

(52) U.S. Cl.
CPC ..... *F24F 11/88* (2018.01); *F24F 11/36* (2018.01); *F24F 11/526* (2018.01); *F24F 11/67* (2018.01); *F24F 11/89* (2018.01); *F25B 41/24* (2021.01)

(58) Field of Classification Search
CPC F24F 11/88; F24F 11/36; F24F 11/526; F24F 11/67; F24F 11/89; F25B 41/24
See application file for complete search history.

(56) References Cited

U.S. PATENT DOCUMENTS

2005/0126264 A1 6/2005 Komninos
2017/0314805 A1 11/2017 Ikawa et al.
2020/0386431 A1 12/2020 Kondrk et al.

FOREIGN PATENT DOCUMENTS

AU 2011208318 A1 * 8/2012 ..... G08B 17/10
CN 102226566 A 10/2011
(Continued)

*Primary Examiner* — Kun Kai Ma
(74) *Attorney, Agent, or Firm* — Cheng-Ju Chiang

(57) ABSTRACT

A control device includes a housing and a circuit board assembly. The circuit board assembly includes a circuit board, a processing chip, a gas detection probe and a controllable switch element. The processing chip is configured to acquire target gas information in an environment through the gas detection probe. A control end of the controllable switch element is electrically connected to the processing chip. An output end of the controllable switch element is configured for electrical connection with an
(Continued)

external device. The processing chip is configured to control switching on or off of the controllable switch element at least according to the target gas information, thereby controlling change of an electrical signal of the external device. An air conditioner having the control device is also disclosed.

20 Claims, 8 Drawing Sheets

(51) Int. Cl.

| | |
|---|---|
| ***F24F 11/526*** | (2018.01) |
| ***F24F 11/67*** | (2018.01) |
| ***F24F 11/89*** | (2018.01) |
| ***F25B 41/24*** | (2021.01) |

(56) References Cited

FOREIGN PATENT DOCUMENTS

| | | | | | |
|---|---|---|---|---|---|
| CN | 202188563 | U | | 4/2012 | |
| CN | 207232133 | U | | 4/2018 | |
| CN | 110864428 | A | | 3/2020 | |
| CN | 210534089 | U | * | 5/2020 | |
| CN | 111735575 | A | | 10/2020 | |
| CN | 112198134 | A | * | 1/2021 | ..... G01N 21/3504 |
| CN | 113154632 | A | | 7/2021 | |
| CN | 214040124 | U | * | 8/2021 | |
| DE | 102005000616 | A1 | * | 7/2006 | ..... G01N 33/0032 |
| JP | 2005189238 | A | * | 7/2005 | |
| KR | 1999-011690 | A | | 2/1999 | |
| TW | M415274 | U | * | 11/2011 | |
| WO | 2020/205430 | A1 | | 10/2020 | |
| WO | 2021/215526 | A1 | | 10/2021 | |

* cited by examiner

CONTROL DEVICE AND AIR CONDITIONER WITH SIMPLIFIED INSTALLATION COMPLEXITY

CROSS-REFERENCE TO RELATED APPLICATION

This patent application is a 35 U.S.C. § 371 National Phase conversion of International (PCT) Patent Application No. PCT/CN2022/076130, filed on Feb. 14, 2022, which claims priority of a Chinese Patent Application No. 202111448185.9, filed on Nov. 30, 2021 and titled "CONTROL DEVICE AND AIR CONDITIONER", the entire content of which is incorporated herein by reference. The PCT International Patent Application was filed and published in Chinese.

TECHNICAL FIELD

The present disclosure relates to a technical field of air conditioners, and in particular, to a control device and an air conditioner.

BACKGROUND

When a refrigerant of an air conditioning system leaks, especially some air conditioning systems that use flammable refrigerants, the leakage of refrigerant is prone to safety hazards. In the related art, a sensor is used to detect refrigerant gas. The sensor includes a housing, a circuit board inside the housing, a gas detection probe and other components. If there is a refrigerant leakage, the sensor transmits the refrigerant leakage information to a controller of the air conditioning system through a communication line. The controller implements a corresponding control strategy through its circuit control board, such as controlling a fan of an indoor heat exchanger to open to disperse the accumulated refrigerant as soon as possible.

In order to realize the above detection and control functions, the existing air conditioning system needs to install a complex control unit including a controller, a sensor, a communication line between the two, and so on. Therefore, the related technology needs to be improved.

SUMMARY

In view of this, the present disclosure provides a control device and an air conditioner having the control device. The present disclosure is beneficial to reduce the installation complexity of the control device. Correspondingly, it is also beneficial to reduce the installation complexity of the air conditioner having the control device.

In a first aspect, an embodiment of the present disclosure provides a control device, the control device includes a housing and a circuit board assembly, the circuit board assembly includes a circuit board, a processing chip, a gas detection probe and a controllable switch element;

wherein the circuit board is located in the housing; the processing chip, the gas detection probe and the controllable switch element are all mounted on the circuit board; the circuit board is limitedly connected or fixedly connected to the housing; and wherein the gas detection probe is electrically connected with the processing chip; the processing chip is configured to acquire target gas information in an environment through the gas detection probe; a control end of the controllable switch element is electrically connected to the processing chip; an output end of the controllable switch element is configured for electrical connection with an external device; and the processing chip is configured to control switching on or off of the controllable switch element at least according to the target gas information, thereby controlling change of an electrical signal of the external device.

In the control device of the present disclosure, the circuit board is located in the housing, the processing chip, the gas detection probe and controllable switch elements are mounted on the circuit board, and the processing chip can not only obtain the target gas information in the environment through the gas detection probe, but also control the on-off of the switching element at least according to the target gas information, so as to control the change of the electrical signal of the external device, which reduce the installation complexity of the control device of the present disclosure.

In a second aspect, an embodiment of the present disclosure provides an air conditioner, the air conditioner includes an indoor unit and an outdoor unit, the indoor unit includes an indoor heat exchanger, the outdoor unit includes a compressor and an outdoor heat exchanger; wherein the air conditioner further includes the aforementioned control device, and the control device is mounted on the indoor unit. The air conditioner provided by the present disclosure includes the above-mentioned control device, thereby helping to reduce the installation complexity of the air conditioner.

DETAILED DESCRIPTION

In order to better understand the technical solutions of the present invention, the embodiments of the present invention are described in detail below with reference to the accompanying drawings.

Figure 1:
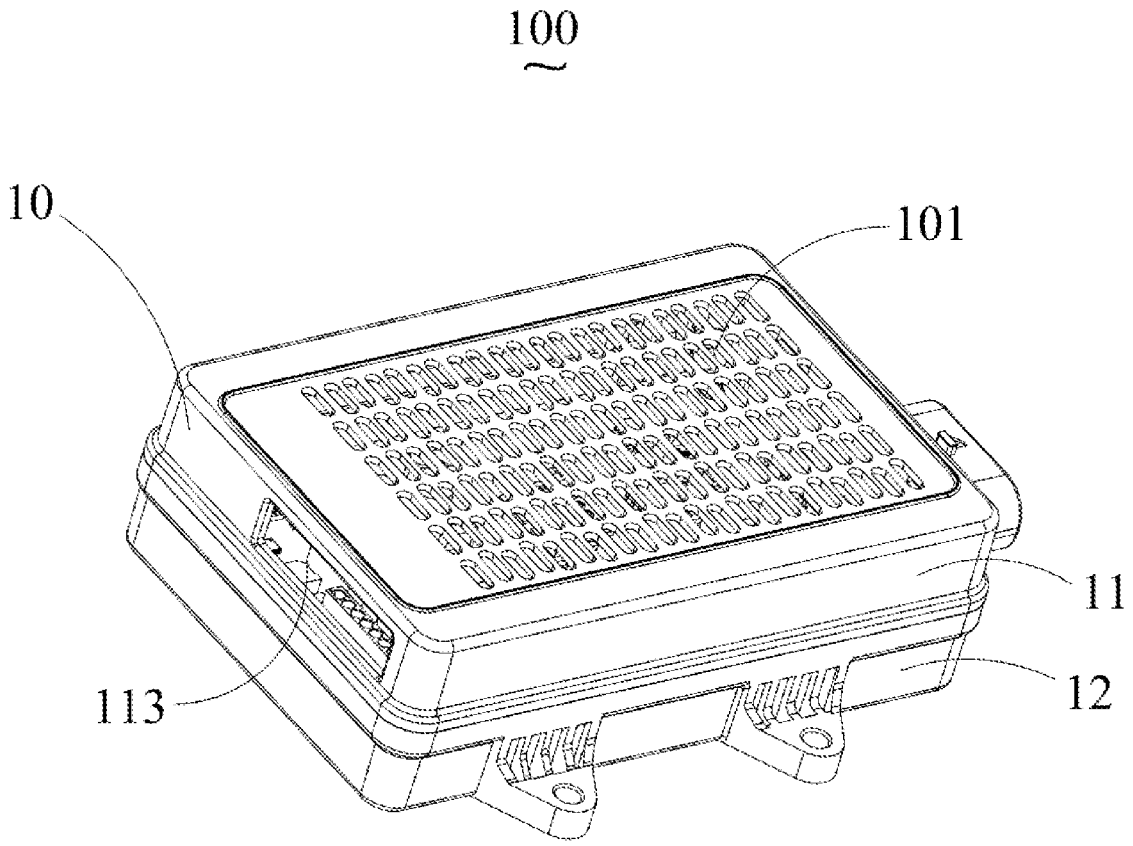
FIG. 1 is a schematic structural view of a control device provided by an embodiment of the present disclosure.

FIG. 1 is a schematic structural view of a control device 100 provided in an embodiment of the present disclosure. The control device 100 includes a housing 10 and a circuit board assembly. The control device 100 also has an inner cavity 200. The housing 10 is provided on a periphery of the inner cavity 200.

The housing 10 is provided with a ventilation hole 101 which is in gas communication with the inner cavity 200. In other words, through the ventilation hole 101, the gas in the environment can enter the inner cavity 200 of the housing 10. In a specific implementation, a waterproof and breathable membrane can be added at the ventilation hole 101 of the housing 10, so that the waterproof and breathable membrane allows gas to enter the housing 10 and avoids the risk of damage to electronic components caused by the entry of dust and liquid.

Figure 2:
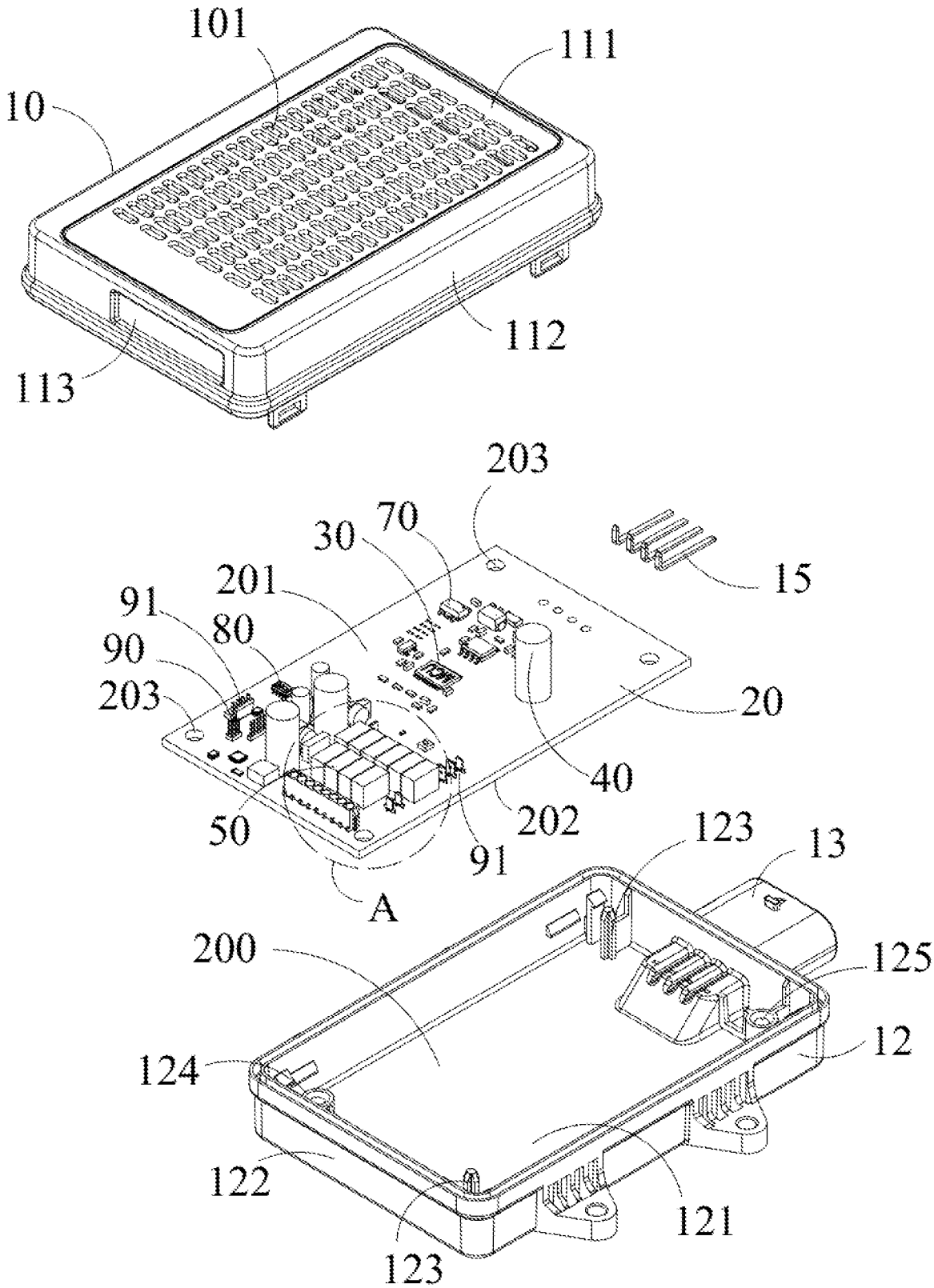
FIG. 2 is an exploded schematic structural view of the control device provided by the embodiment of the present disclosure.

As shown in FIG. 2, the circuit board assembly includes a circuit board 20, a processing chip 30, a gas detection probe 40 and a controllable switch element 50. Specifically, the circuit board 20, the processing chip 30, the gas detection probe 40 and the controllable switch element 50 are all located in the inner cavity 200. The processing chip 30, the gas detection probe 40 and the controllable switch element 50 are all mounted to the circuit board 20.

In the embodiment shown in FIG. 2, the control device 100 may have only one circuit board 20. The circuit board 20 has a first surface 201 and a second surface 202 which are located on different sides in a thickness direction thereof. In the thickness direction of the circuit board 20, the first surface 201 is closer to the ventilation hole 101 than the second surface 202. The processing chip 30, the gas detection probe 40 and the controllable switch element 50 are all mounted on the first surface 201. The above-mentioned components are soldered to the first surface 201 of the circuit board 20 by surface soldering or pin through-hole soldering. Of course, the circuit board assembly may also include common electronic components such as capacitors, resistors, and inductors mounted on the circuit board 20, which will not be repeated here.

Figure 4:
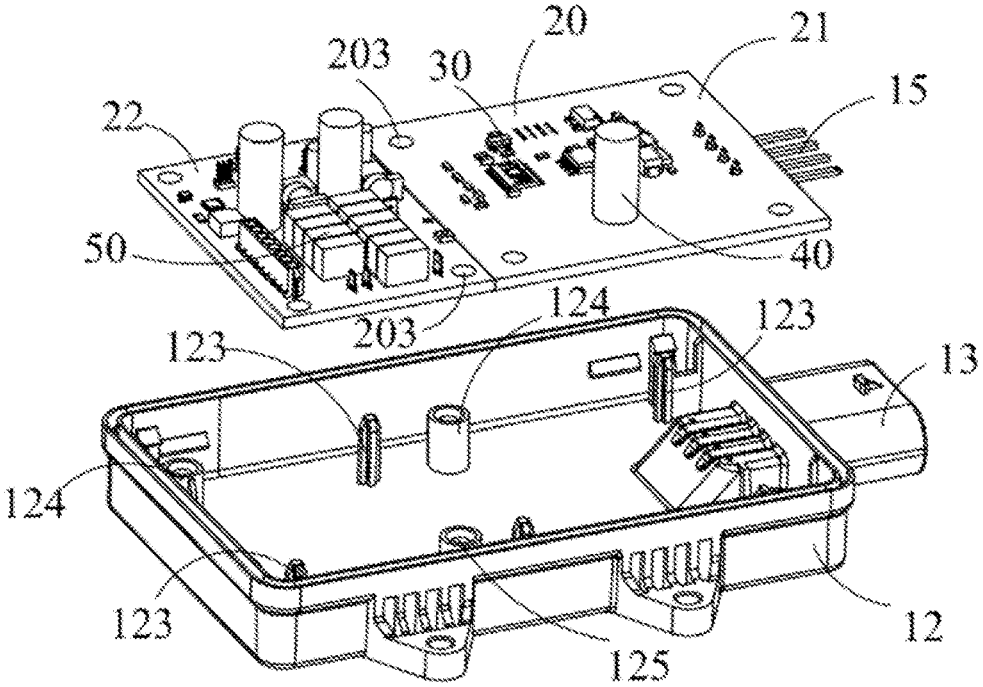
FIG. 4 is an exploded schematic view of a partial structure of another control device provided by an embodiment of the present disclosure.
Figure 5:
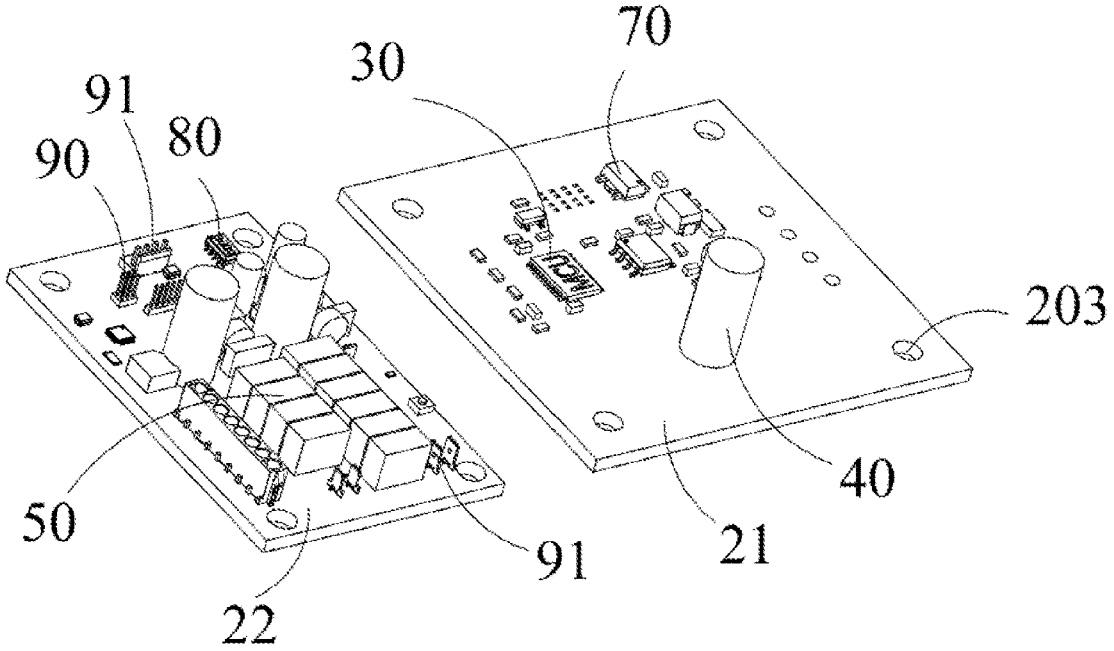
FIG. 5 is an exploded schematic structural view of the circuit board assembly in FIG. 4.

In other embodiments of the present disclosure, the circuit board assembly includes at least two circuit boards provided separately. The at least two circuit boards are arranged in the housing 10 side by side. FIG. 4 and FIG. 5 both illustrate with two circuit boards arranged separately. The two circuit boards are placed side by side to save space. The two circuit boards include a first circuit board 21 and a second circuit board 22. The gas detection probe 40 and the processing chip 30 are mounted on the first circuit board 21, and the controllable switch element 50 is mounted on the second circuit board 22. Of course, the processing chip 30 and the controllable switch element 50 may also be mounted on the first circuit board 21. Alternatively, a plurality of the processing chips 30 may be provided. For example, a processing chip 30 that performs the detection function of the target gas is mounted on the first circuit board 21. Another processing chip 30 that performs the control function for an external device is mounted on the second circuit board 22. The present disclosure does not limit this too much. The function of the two circuit boards is similarly to the one circuit board shown in FIG. 3. During specific implementation, the first circuit board 21 and the second circuit board 22 may be electrically connected through a conductive structure. Disposing at least two or more circuit boards in the same housing can facilitate the maintenance or replacement of one of the circuit boards independently.

In summary, no matter one circuit board, two circuit boards or more circuit boards are provided, the circuit boards are all accommodated in the housing 10, so that the control device 100 can not only detect the target gas information through the gas detection probe 40, but also control the on and off of the controllable switch element 50 by the processing chip 30, thereby controlling the change of the electrical signal of the external device, such as turning on or off. In this way, when the control device 100 is installed, since one control device 100 realizes the detection of the target gas and the control of the external device, it is not necessary to install a controller, a sensor, and a communication line between the two, separately. The entire control device 100 has a simple structure, convenient installation, and high assembly efficiency with other components of the air conditioner. At the same time, the installation space occupied by the control device 100 can also be saved.

Hereinafter, the structure of the control device 100 of the present disclosure will be described in detail by using one circuit board 20.

Referring to FIG. 2, the housing 10 includes a first housing 11 and a second housing 12. The first housing 11 and the second housing 12 are assembled and fixed to each other along a top-to-bottom direction. The first housing 11 includes a first housing wall 111 and a first peripheral wall 112 vertically extending from the first housing wall 111. The second housing 12 includes a second housing wall 121 and a second peripheral wall 122 vertically extending from the second housing wall 121. The first peripheral wall 112 and the second peripheral wall 122 are fixed. Specifically, the first peripheral wall 112 and the second peripheral wall 122 can be fixed to each other by means of snaps or the like. The snap connection does not require screws, which has a simple structure, is easy to assemble, and facilitates disassembly of the housing 10 during maintenance. The circuit board 20 is located in the inner cavity 200. Specifically, the circuit board 20 is located in the second housing 12, and the circuit board 20 is limitedly connected or fixedly connected to the second housing 12. Exemplarily, the second housing 12 includes a plurality of first support posts 123 protruding upward from the second housing wall 121. Corners of the circuit board 20 have corner holes 203 provided therethrough. The first support posts 123 can extend into the corner holes 203 to position the circuit board 20. A cross section of the first support post 123 may be cross-shaped. Of course, the cross section of the first support post 123 can also be in other shapes. Alternatively, the second housing 12 includes a plurality of second supporting posts 124 protruding upward from the second housing wall 121. A part of the corner holes 203 of the circuit board 20 are matched with the first support posts 123, and another part of the corner holes 203 are matched with the second support posts. The second surface 202 of the circuit board 20 is in contact with the second support posts 124. The second support posts 124 have screw holes 125 aligned with the corner holes 203 of the circuit board 20. Screws 24 are inserted into the corner holes 203 of the circuit board 20 and screwed into the screw holes 125 of the second support posts 124. In FIG. 2, the second housing 12 has two diagonally arranged first support posts 123 and two diagonally arranged second support posts 124. The first support posts 123 are matched with the corner holes 203 of the circuit board to facilitate assembly and positioning. The second support posts 124, the corner holes 203 of the circuit board and the screws 24 cooperate to realize the fastening of the circuit board 20 and the second housing 12. In FIG. 4, since the circuit board assembly has two circuit boards, in order to realize fixation of the two circuit boards, the second housing may be respectively provided with two first support posts 123 and two second support posts 124 for each circuit board.

The first housing wall 111 and the second housing wall 121 are located on different sides of the circuit board 20 in the thickness direction, respectively. The first housing wall 111 faces the first surface 201 of the circuit board 20. The ventilation hole 101 is provided on the first housing wall 111. Multiple ventilation holes 101 are provided, and the multiple ventilation holes 101 are arranged in a plurality of rows, with each row having multiple ventilation holes. In addition, the adjacent two rows of ventilation holes 101 are arranged in a staggered position, which is convenient for expanding a path of gas entering the inner cavity 200 and for uniform air intake. The second housing wall 121 faces the second surface 202 of the circuit board 20. At least part of the gas detection probe 40 is located between the ventilation hole 101 and the circuit board 20. The circuit board 20 may have a rectangular board body. Multiple controllable switch elements 50 may be provided. The multiple controllable switch elements 50 are arranged in at least one row along a width direction of the circuit board 20. The first peripheral wall 112 is provided with a wire harness fitting hole 113 therethrough. In a length direction of the circuit board 20, the controllable switch element 50 is closer to the wire harness fitting hole 113 than the gas detection probe 40. The wire harness fitting hole 113 can allow a wire harness leading from the output end of the controllable switch element 50 to pass through. The proximity of the controllable switch element 50 to the wire harness fitting hole 113 can decrease the interference of the wire harness leading from the controllable switch element 50 with other circuit elements of the circuit board 20. In addition, the aggregation of the plurality of controllable switch elements is also beneficial to the relatively concentrated arrangement of the wire harnesses passing through the wire harness fitting hole 113.

As shown in FIG. 2, FIG. 4, FIG. 8 and FIG. 9, in some embodiments of the present disclosure, the control device 100 further includes connection terminals 15. The connection terminals 15 are metal terminals. The second housing 12 is injection-molded with the connection terminals 15 using the connection terminals 15 as inserts, so that the connection terminals 15 and the second housing 12 are integrally formed. Both the first housing 11 and the second housing 12 may be plastic housings. The second housing 12 has a plug portion 13 extending outwards from the second peripheral wall 122. The plug portion 13 has a cavity 14. The connection terminal 15 includes a first end portion 151 and a second end portion 152. The first end portion 151 is connected to the circuit board 20. Specifically, the circuit board 20 is provided with a through hole matched with the first end portion 151. The first end portion 151 is at least partially received in the through hole, and the first end portion 151 is soldered and integrally fixed to the circuit board at the through hole. The second end portion 152 is located in the cavity 14. The gas detection probe 40 is closer to the first end portion 151 than the controllable switch element 50 in the length direction of the circuit board 20. The connection terminal 15 facilitates the plug connection between the control device and some external devices. For example, a communication signal can be transmitted to some external devices through the connection terminal 15.

The gas detection probe 40 is used to detect the concentration of a gaseous refrigerant (e.g. R32, R454B, etc.). The gas detection probe 40 can be one of a semiconductor type gas detection probe, an infrared type gas detection probe and a thermal conductivity type gas detection probe 40 according to its working principle. The gas detection probe 40 is electrically connected to the processing chip 30. The processing chip 30 can acquire target gas information in the environment through the gas detection probe 40.

Figure 6:
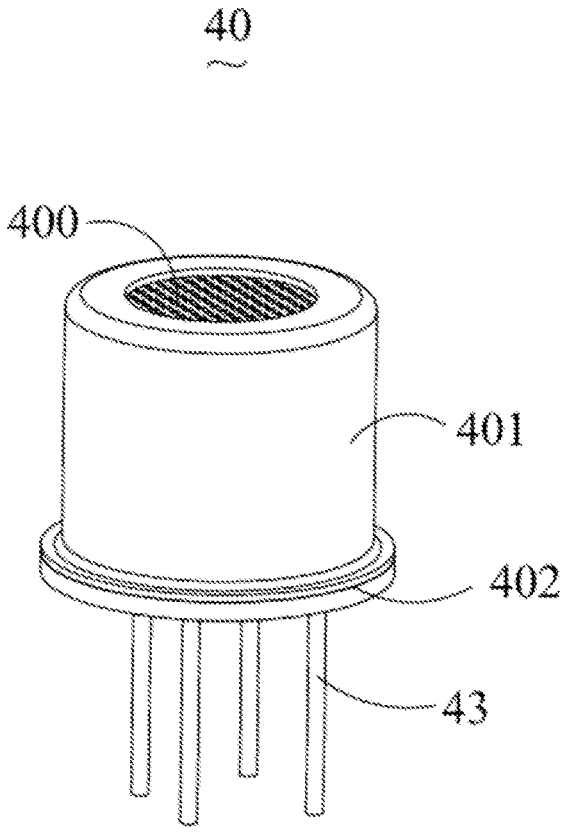
FIG. 6 is a schematic structural view of a gas detection probe provided by an embodiment of the present disclosure.
Figure 7:
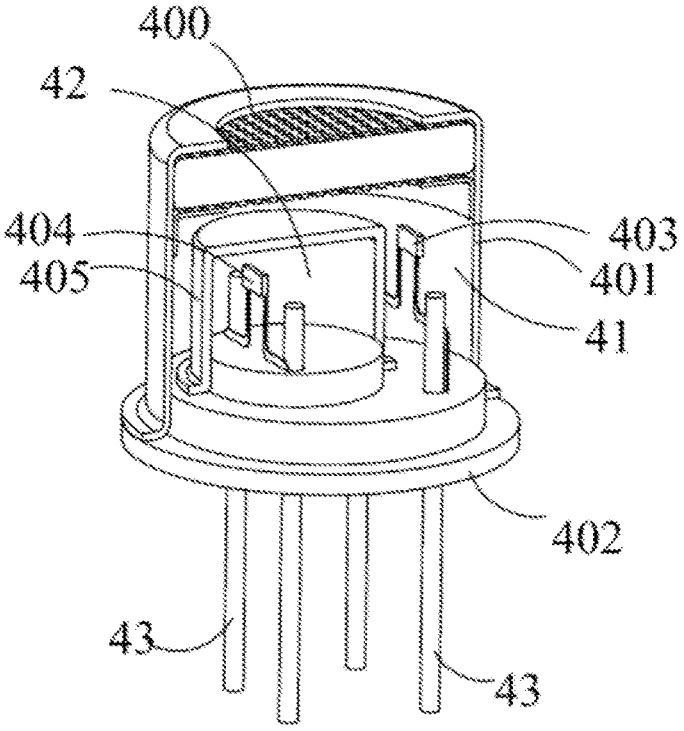
FIG. 7 is a perspective cross-sectional view of the gas detection probe of FIG. 6.
Figure 8:
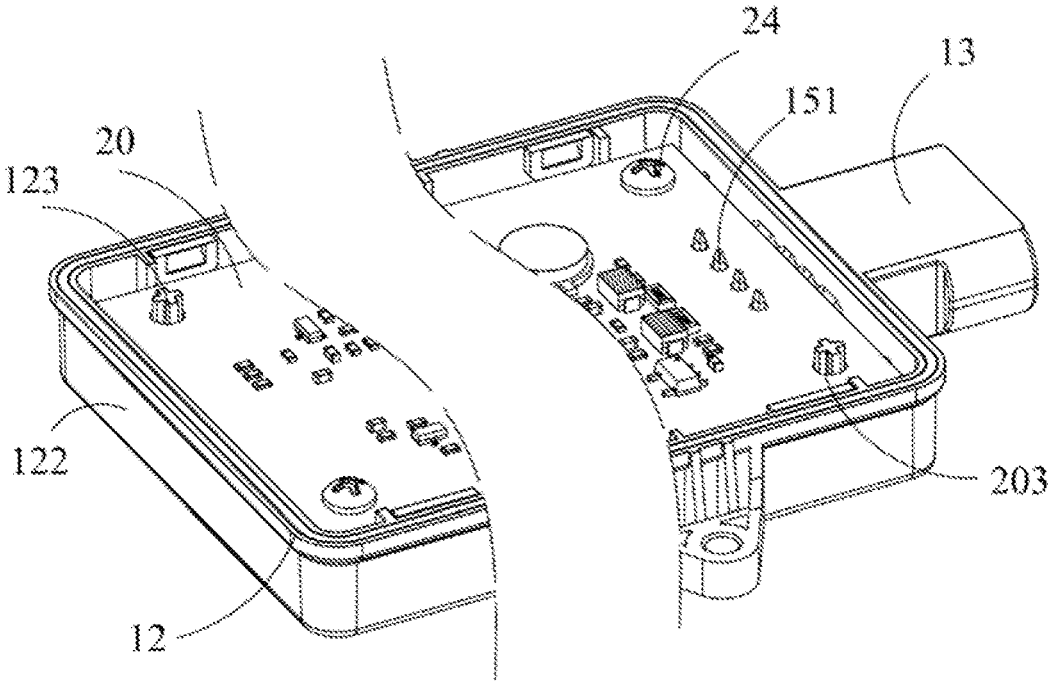
FIG. 8 is a partial schematic structural view of the control device provided by an embodiment of the present disclosure.
Figure 9:
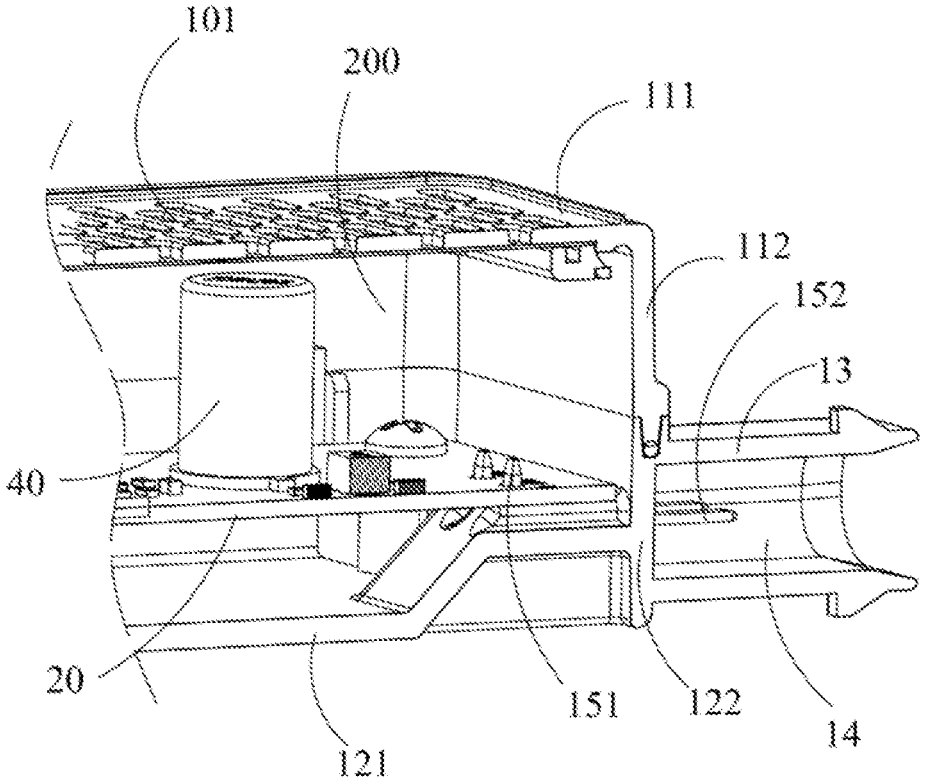
FIG. 9 is a partial schematic structural view of the control device provided by an embodiment of the present disclosure.

Referring to FIG. 6 and FIG. 7, the gas detection probe 40 based on a principle of thermal conductivity is shown. A shell portion of the gas detection probe 40 includes an outer shell 401 and a support seat 402 welded together. The gas detection probe 40 may be provided with two thermistors, namely a first thermistor 403 and a second thermistor 404, respectively. The first thermistor 403 is placed in an open space 41. A gas channel 400 is provided through the outer shell 401. The gas channel 400 communicates the open space 41 with the inner cavity 200 of the control device 100. The second thermistor 404 is placed in a sealed shell space. Specifically, the shell portion of the gas detection probe 40 further includes an inner shell 405 sealed and welded with the support seat 402. The inner shell 405 and the support seat 402 form a closed sealed space 42. The second thermistor 404 located in the sealed space 42 only contacts the environmental gas in the sealed space 42, which is not doped with the target gas to be detected, such as R32 refrigerant gas. Therefore, the second thermistor 404 can be used as a reference element, and the first thermistor 403 can be used as a detection element. By comparing the difference in electrical signals between the first thermistor 403 and the second thermistor 404, the concentration of the target gas in the environment can be detected. In order to facilitate the transmission of the signals of the two thermistors, the gas detection probe 40 also has pins 43 connected to the two thermistors, respectively. The pins 43 protrude through the through holes on the support seat 402, and are finally soldered and mounted on the circuit board 20. A plurality of conductive paths (not shown) are also provided on the circuit board 20. For example, the electrical connection between the electronic components mounted on the circuit board 20 can be realized through the conductive paths, so that the gas detection probe 40 is electrically connected to the processing chip 30 through the conductive paths of the circuit board 20.

A control terminal of the controllable switch element 50 is electrically connected to the processing chip 30. The output end of the controllable switch element 50 can be electrically connected to an external device. The processing chip 30 can control the on or off of the controllable switch element 50 at least according to the target gas information, thereby controlling the on or off of the electrical signal of the external device or the change of the power-on state. In some embodiments, because the environment in which the control device 100 is applied may be an air conditioner using a flammable refrigerant. Therefore, a switch element with an explosion-proof function can be selected as the controllable switch element 50. Such a controllable switch element with the explosion-proof function is not easy to generate arcs or sparks, which is correspondingly safer and more reliable applied in an environment where a flammable refrigerant is used.

Figure 3:
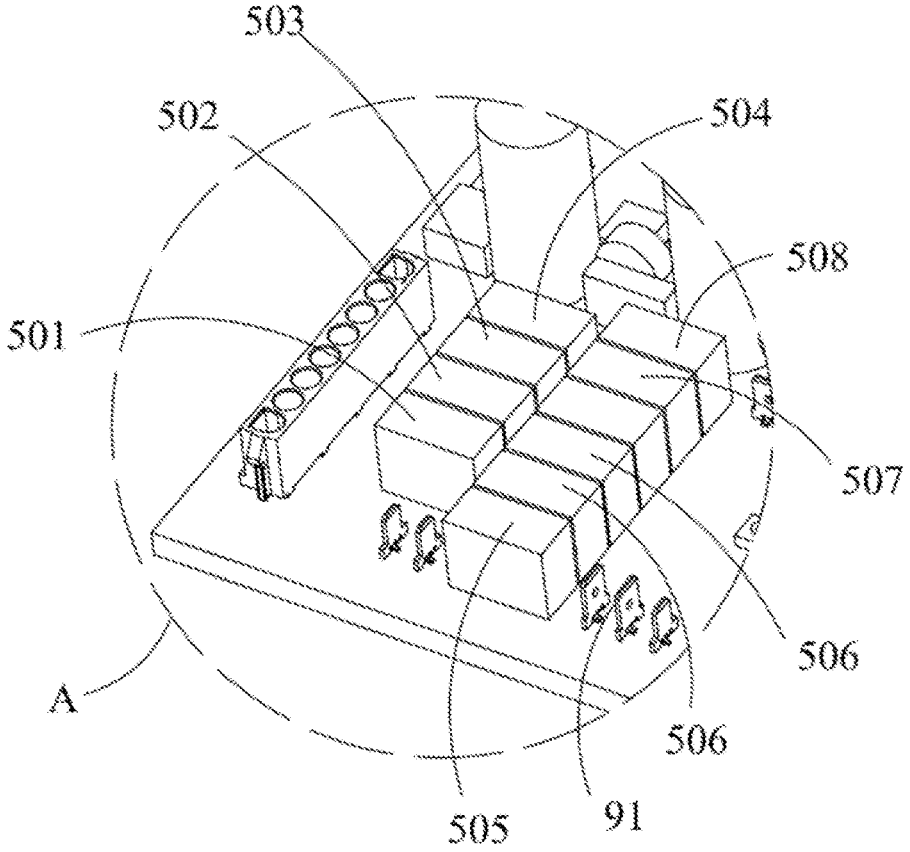
FIG. 3 is an enlarged structural representation of portion A in FIG. 2.
Figure 11:
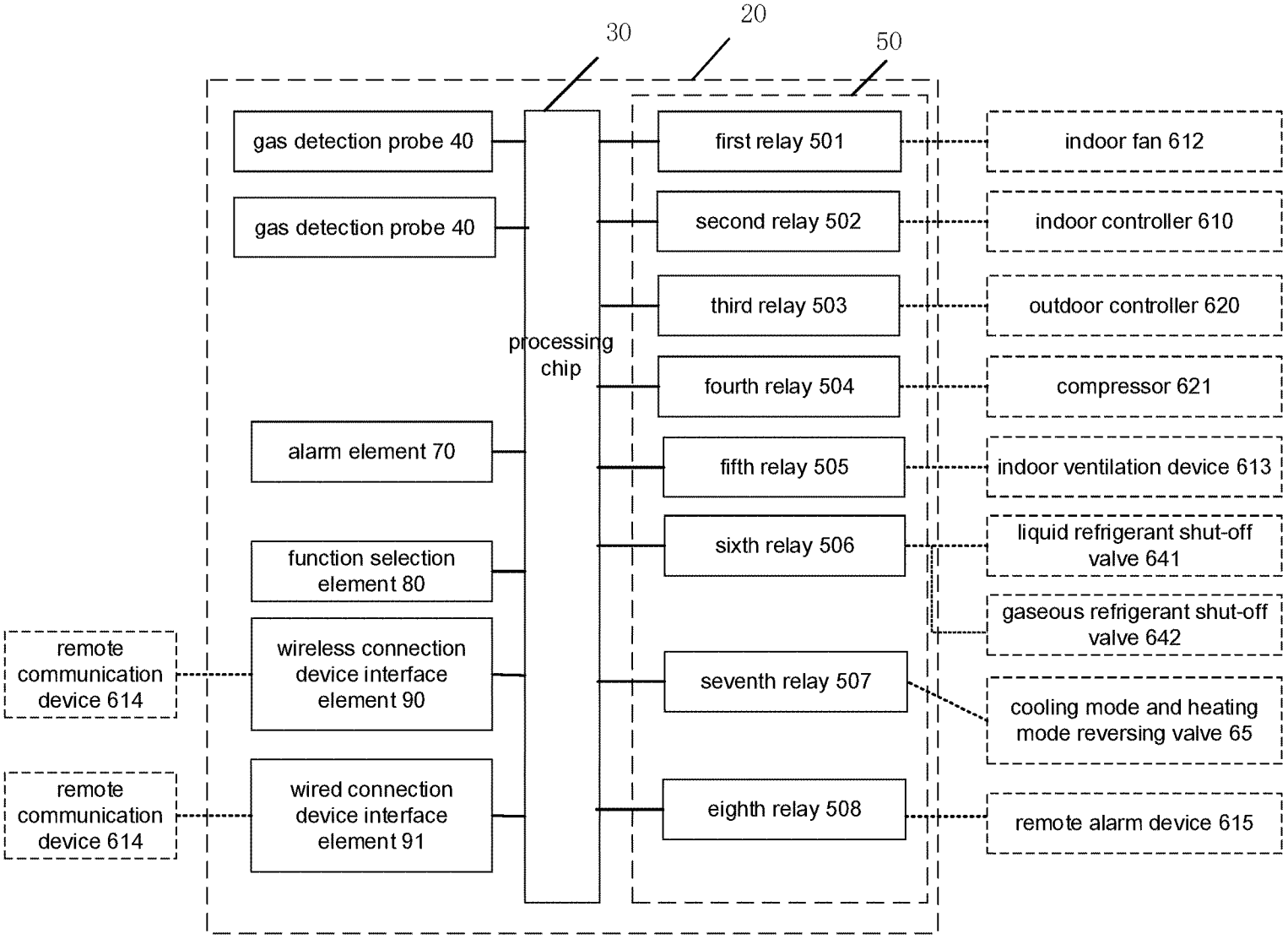
FIG. 11 is a schematic structural view of a functional module of the control device provided by an embodiment of the present disclosure.

Referring to FIG. 3 and FIG. 11, there may be at least one controllable switch element 50 mounted on the circuit board 20. The at least one controllable switch element 50 includes one or more of a first relay 501 for controlling the opening and closing of an indoor fan 612 of an air conditioning system, a second relay 502 for controlling power on or off of an indoor controller 610 of the air conditioning system, a third relay 503 for controlling power on or off of an outdoor controller 620 of the air conditioning system, a fourth relay 504 for controlling on or off of a compressor 621, a fifth relay 505 for controlling opening or closing of an indoor ventilation device 613, a sixth relay 506 for controlling an on-off valve 64 of the pipeline of the air conditioning system to turn on or off, a seventh relay 507 for controlling a state of a reversing valve 65 for switching between a cooling mode and a heating mode of the air conditioning system, and an eighth relay 508 for controlling a remote alarm device to activate or deactivate an alarm.

Figure 10:
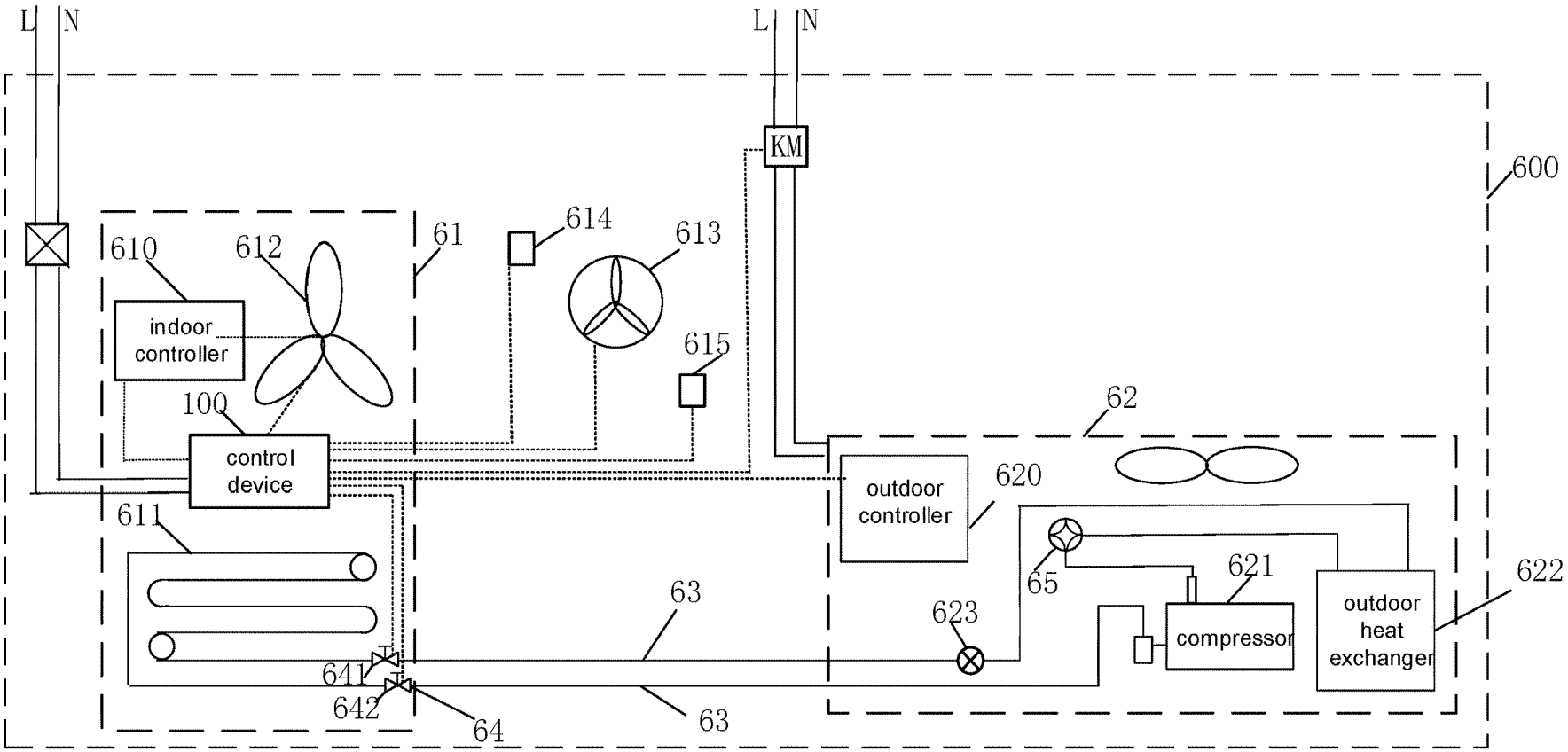
FIG. 10 is a schematic structural view of an air conditioner provided by an embodiment of the present disclosure.

FIG. 10 is a schematic structural view of an existing air conditioner 600. The air conditioner 600 includes an indoor unit 61 and an outdoor unit 62. The indoor unit 61 includes an indoor heat exchanger 611. The outdoor unit 62 includes a compressor 621, an outdoor heat exchanger 622 and a throttle element 623. In some embodiments, the indoor unit 61 includes an indoor controller 610. The outdoor unit 62 includes an outdoor controller 620. The air conditioner 600 further includes a refrigerant pipe 63. For example, the refrigerant pipe 63 may be located between the indoor unit 61 and the outdoor unit 62. The air conditioner 600 also includes the aforementioned control device 100. It should be noted that in some other implementations, the indoor controller 610 and the outdoor controller 620 may be absent. That is, the air conditioner 600 realizes direct control of external devices, such as the compressor, the fans of the indoor and outdoor heat exchangers, the remote alarm device, and the indoor ventilation device, etc., through the control device 100.

The control device 100 is mounted on the indoor unit 61. Specifically, since the control device 100 includes the gas detection probe 40, the control device 100 can be located at a position where the refrigerant of the indoor heat exchanger 611 of the air conditioner 600 tends to accumulate or leak. For example, the control device 100 is placed at a pipeline connection of the indoor heat exchanger 611. This is beneficial to shorten the response time of the gas detection probe 40. Correspondingly, the control device 100 may execute a corresponding control strategy in time based on the leakage of the refrigerant (target gas).

A plurality of controllable switch elements 50 may be provided and mounted on the circuit board 20 of the control device 100. Exemplarily, the controllable switch element 50 includes the first relay 501. A control terminal of the first relay 501 is electrically connected to the processing chip 30. An output end of the first relay 501 is electrically connected to the indoor fan 612. Of course, a power terminal of the first relay 501 may be electrically connected to a power output terminal of the circuit board 20. The processing chip 30 is used to control the switch-on or switch-off of the first relay 501 at least according to the refrigerant information, thereby controlling the switch-on and switch-off of the indoor fan 612 of the air conditioning system.

In an embodiment of the present disclosure, the air conditioner 600 includes the indoor fan 612. After the control device 100 detects the refrigerant leakage, the processing chip 30 on the circuit board 20 can control the first relay 501 to turn on, thereby controlling the indoor fan 612 to turn on. The indoor fan 612 can quickly diffuse the leaked refrigerant, prevent the refrigerant from accumulating after leakage, reduce the concentration of the refrigerant, and prevent the occurrence of potential safety hazards. The indoor fan 612 can be controlled to work at the maximum speed, so as to blow away the leaked refrigerant at the fastest speed, thereby preventing the refrigerant from accumulating and causing risks.

It should be noted that power input to a power input terminal of the circuit board 20 may be a power frequency power supply, such as AC 220V, AC 230V, and the like. The power frequency voltage is electrically connected to the power input terminal of the circuit board 20 through a transformer. The power input at the power input terminal of the control device 100 may also be AC/DC 24V or other voltage power sources. Through corresponding voltage converters, the input power is converted into the working voltages of other components (e.g., the indoor controller 610, the indoor fan 612 and so on) in the air conditioner 600.

As shown in FIG. 3 and FIG. 11, the controllable switch element 50 further includes the second relay 502. A control terminal of the second relay 502 is electrically connected to the processing chip 30. An output end of the second relay 502 is electrically connected to the power supply of the indoor controller 610. Of course, a power terminal of the second relay 502 may be electrically connected to the power output terminal of the circuit board 20. The processing chip 30 is used to control the switch-on or switch-off of the second relay 502 at least according to the refrigerant information, thereby controlling the power-on or power-off of the indoor controller 610.

The indoor controller 610 in the existing air conditioner 600 is always in a power-on state after the air conditioner 600 is powered on. Therefore, the explosion-proof requirements for the indoor controller 610 are relatively high. In the embodiments of the present disclosure, the control device 100 is added to the air conditioner 600. Since the control device 100 includes the second relay 502, in the case of refrigerant leakage, the processing chip 30 of the control device 100 can control the indoor controller 610 to power off, thereby reducing the explosion-proof requirements for the indoor controller 610.

As shown in FIG. 3 and FIG. 11, the controllable switch element 50 further includes the third relay 503. A control terminal of the third relay 503 is electrically connected to the processing chip 30. An output end of the third relay 503 is electrically connected to the power supply of the outdoor controller 620. Of course, a power terminal of the third relay 503 may be electrically connected to the power output terminal of the circuit board 20. The processing chip 30 is used to control the switch-on or switch-off of the third relay 503 at least according to the refrigerant information, thereby controlling the power-on or power-off of the outdoor controller 620. During the refrigerant leakage period, in order to recover the refrigerant, the processing chip 30 of the control device 100 controls to switch on the third relay 503, so as to control to supply power for the outdoor controller 620.

As shown in FIG. 3 and FIG. 11, the controllable switch element 50 further includes the fourth relay 504. A control terminal of the fourth relay 504 is electrically connected to the processing chip 30. An output end of the fourth relay 504 is electrically connected to the compressor 621. Of course, a power terminal of the fourth relay 504 may be electrically connected to the power output terminal of the circuit board 20. The processing chip 30 is used to control the switch-on or switch-off of the fourth relay 504 at least according to the refrigerant information, thereby controlling the turning on or off of the compressor 621. When the control device 100 detects the leakage of the refrigerant, the processing chip 30 controls to switch on the fourth relay, thereby controlling the compressor 621 to start running. When the air conditioner 600 is in a cooling mode, the compressor 621 can continuously extract the refrigerant from the indoor unit 61, so as to reduce the concentration of the refrigerant in the room, prevent the accumulation of the refrigerant in the room which leads to a potential safety hazard. In order to improve the efficiency of discharging the refrigerant, the compressor 621 can be controlled to operate at the maximum frequency when it is fully loaded.

As shown in FIG. 3 and FIG. 11, the controllable switch element 50 further includes the fifth relay 505. A control terminal of the fifth relay 505 is electrically connected to the processing chip 30. An output end of the fifth relay 505 is electrically connected to the indoor ventilation device 613. Of course, a power terminal of the fifth relay 505 may be electrically connected to the power output terminal of the circuit board 20. The processing chip 30 is used to control the switch-on or switch-off of the fifth relay 505 at least according to the refrigerant information, thereby controlling the turning on or off of the indoor ventilation device 613. The indoor ventilation device 613 provided by the embodiment of the present disclosure may be a fresh air system installed indoors. The control device 100 turns on the indoor ventilation device 613 after the leakage of the refrigerant is detected, so as to discharge the refrigerant accumulated in the room to the outside, reduce the indoor refrigerant concentration quickly, and prevent potential safety hazards.

As shown in FIG. 3 and FIG. 11, the controllable switch element 50 further includes the sixth relay 506. A control terminal of the sixth relay 506 is electrically connected to the processing chip 30. An output end of the sixth relay 506 is electrically connected to the on-off valve 64 of the pipeline of the air conditioning system. Of course, a power terminal of the sixth relay 506 may be electrically connected to the power output terminal of the circuit board 20. The processing chip 30 is used to control the switch-on or switch-off of the sixth relay 506 at least according to the refrigerant information, thereby controlling the turning on or off of the on-off valve 64 of the pipeline of the air conditioning system. The on-off valve 64 of the pipeline of the air conditioning system provided by the embodiment of the present disclosure may be a liquid refrigerant shut-off valve 641 disposed between the throttle element 623 and the inlet of the indoor heat exchanger 611, and a gaseous refrigerant shut-off valve 642 provided between the outlet of the indoor heat exchanger 611 and the compressor 621. Multiple six relays 506 may be provide to control the on-off of the above two valve components respectively. After the control device 100 detects the refrigerant leakage, the processing chip 30 controls the liquid refrigerant shut-off valve 641 to shut off through the sixth relay 506. The processing chip 30 controls the gaseous refrigerant shut-off valve 642 to switch on through the sixth relay 506. In this way, the gaseous refrigerant shut-off valve 642 is opened to discharge the refrigerant from the indoor to the outdoor. The liquid refrigerant shut-off valve 641 is shut off, to avoid the refrigerant from continuously flowing into the room from the outdoors. As a result, it is beneficial to reduce the concentration of the indoor refrigerant, and prevent the occurrence of potential safety hazards.

As shown in FIG. 3 and FIG. 11, the controllable switch element 50 further includes the seventh relay 507. A control terminal of the seventh relay 507 is electrically connected to the processing chip 30. An output end of the seventh relay 507 is electrically connected to the reversing valve 65 for controlling the air conditioning system to switch between the cooling mode and the heating mode. Of course, a power terminal of the seventh relay may be electrically connected to the power output terminal of the circuit board 20. The processing chip 30 is used to control the on-off of the seventh relay 507 at least according to the refrigerant information. The on-off of the seventh relay 507 affects the reversing state of the reversing valve 65, and furtherer, controls the air conditioner 600 to execute the cooling mode or the heating mode. After the control device 100 detects the refrigerant leakage, the processing chip 30 controls the seventh relay 507 to send a switching signal of the reversing valve 65 to the reversing valve 65 so that the reversing valve 65 switches to a target state. The target state is a state in which the air conditioner 600 is controlled to be in the cooling mode. At this time, the compressor 621 continues to draw the refrigerant from the indoor unit 61. Correspondingly, the liquid refrigerant shut-off valve 641 can be shut off in cooperation with the sixth relay 506. The indoor refrigerant cannot be replenished, and the indoor refrigerant is continuously recycled to the outdoors, thereby reducing the total amount of refrigerant released into the indoor space, and enhancing the indoor safety accordingly.

As shown in FIG. 3 and FIG. 11, the controllable switch element 50 further includes the eighth relay 508. A control terminal of the eighth relay 508 is electrically connected to the processing chip 30. An output end of the eighth relay 508 is electrically connected to the remote alarm device 615. Of course, a power terminal of the eighth relay 508 may be electrically connected to the power output terminal of the circuit board 20. The processing chip 30 is used to control the on-off of the eighth relay 508 at least according to the refrigerant information. The on-off of the eighth relay 508 affects the alarm state of the remote alarm device 615, such as starting the alarm or stopping the alarm. The remote alarm device 615 can be an intelligent light alarm device, an intelligent voice alarm device, or an LED light or a buzzer set on the indoor controller, and so on. After the control device 100 detects the leakage of the refrigerant, the processing chip 30 controls the remote alarm device 615 to issue warning information by controlling the eighth relay 508. The advantage of this is that, since the control device 100 is usually arranged inside the indoor heat exchanger, some voice alarm elements or light alarm elements of the control device 100 itself may not be easily noticed by the user. However, the remote alarm device 615 can be placed in a more obvious position to be easily observed by the user, so that the alarm information can be more easily received by the user through the control of the eighth relay 508.

It should be noted that the controllable switch element 50 may be other types of controllable switch element 50 in addition to the relay, such as a MOS transistor, a triode or a thyristor.

In some embodiments of the present disclosure, the circuit board assembly further includes at least one alarm element 70 mounted on the circuit board 20. The alarm element 70 is electrically connected to the processing chip 30. The processing chip 30 can control the alarm element 70 to emit sound and/or light warning information at least according to the target gas information. Specifically, when the refrigerant gas concentration detected by the gas detection probe 40 exceeds a warning value, the processing chip 30 may send a control signal to the alarm element 70. The alarm element 70 can be an LED light, a buzzer or an intelligent voice announcement device. In this way, the alarm element 70 can remind the user of the occurrence of refrigerant leakage by means of a sound alarm or a light alarm.

In some embodiments of the present disclosure, the circuit board assembly further includes a function selection element 80 mounted on the circuit board 20. The number of gas detection probes 40 is at least two. The gas detection probe 40 is one of a thermal conductivity detection probe, an infrared detection probe and a semiconductor detection probe. For example, one of the two gas detection probes 40 is a thermal conductivity type gas detection probe and the other is an infrared type gas detection probe. The function selection element 80 is electrically connected to the processing chip 30. The processing chip 30 can be selectively electrically connected to the at least two gas detection probes 40 according to the setting of the function selection element 80.

Exemplarily, the function selection element 80 includes a plurality of DIP switches. Different processing functions can be realized by setting the state of the DIP switches of different positions. For example, through the DIP switches, the control device 100 can be set to be connected with one gas detection probe 40 or two gas detection probes 40, and different working modes can be selected according to different refrigerant types, such as R32, CO2, R410, etc., of the air conditioner 600, as refrigerant leakage alarm points corresponding to different refrigerants may be different.

In some embodiments of the present disclosure, the circuit board assembly further includes a wireless connection device interface element 90 mounted on the circuit board 20. One end of the wireless connection device interface element 90 is electrically connected to the processing chip 30, and the other end can be electrically connected to a wireless connection device. The wireless connection device interface element 90 may be a Bluetooth interface, an infrared interface, a wireless WiFi interface, or the like. Correspondingly, the wireless connection device matched with the wireless connection device interface element 90 is a Bluetooth module, an infrared module or a WiFi module. These modules may also be connected with the remote communication devices 614. The processing chip 30 can at least instruct the wireless connection device to wirelessly transmit action instructions to other remote communication devices 614 (e.g., mobile phones) according to the target gas information, such as sending warning information at least including target gas leakage to the mobile phone terminals. The user may not be in the indoor range when the refrigerant leak occurred. At this time, the information of refrigerant leakage can be transmitted to the terminal device on the user side through the wireless connection device installed on the circuit board 20. In this way, the user can remotely obtain information about refrigerant leakage, and then perform corresponding user-end operations to reduce safety risks. In addition, through the wireless connection device interface element 90, it is convenient for the user to replace the wirelessly connected device on the circuit board 20. And, when the wireless connection device is damaged, it is easy to replace.

In some embodiments of the present disclosure, the circuit board assembly further includes a wired connection device interface element 91 mounted on the circuit board 20. One end of the wired connection device interface element 91 is electrically connected to the processing chip 30, and the other end can be electrically connected to the remote communication device through a signal transmission line. The processing chip 30 can at least instruct the remote communication device to act according to the target gas information. The wired connection device interface element 91 may include an indoor controller interface of an air conditioning system, an outdoor controller interface of the air conditioning system, and the like. In some application scenarios, the indoor controller or the outdoor controller of the air conditioning system may be controlled directly through a signal transmission line instead of a relay, thereby expanding the application scenarios of the control device 100. The wired connection device interface element 91 may be in the form of a pin, a blade or, for example, the connection terminal 15 in FIG. 2.

In some embodiments of the present disclosure, the circuit board assembly further includes some functional self-checking circuits provided on the circuit board 20. The functional self-checking circuits are electrically connected with the processing chip 30. After the circuit board 20 is powered on, through the functional self-checking circuits, it can realize detecting, for example, whether the circuit loop where the controllable switch element is located is normal, whether the circuit loop where the gas detection probe is located is normal, and whether the entire communication line of the circuit board is normal, etc. As a result, the reliability and safety of the control device can be improved by the functional self-checking circuits arranged on the circuit board.

The above-mentioned circuit board 20 provided in the present disclosure may further include at least one storage unit communicatively connected with the above-mentioned processing chip 30. The storage unit stores program instructions that can be executed by the processing chip 30. The above-mentioned processing chip 30 invokes the program instructions to execute the control of the gas detection probe 40 and the external devices.

In the several embodiments provided in this specification, it should be understood that the disclosed system, apparatus and method may be implemented in other manners. For example, the apparatus embodiments described above are merely illustrative. For example, the division of units is only a logical function division, and there may be other division methods in actual implementation. For example, multiple units or components may be combined or integrated into another system, or some features may be omitted, or not implemented. Another point, the mutual coupling or direct coupling or communication connection shown or discussed may be through some interfaces. Indirect coupling or communication connection of devices or units may be in electrical, mechanical or other forms.

In addition, each functional unit in each embodiment of this specification may be integrated into one processing unit, or each unit may exist physically alone, or two or more units may be integrated into one unit. The above-mentioned integrated unit may be implemented in the form of hardware, or may be implemented in the form of hardware plus software functional units.

The above are only preferred embodiments of the present specification, and are not intended to limit the present specification. Any modification, equivalent replacement, improvement etc., made within the spirit and principle of this specification shall be included within the protection scope of this specification.

What is claimed is:

1. A control device, comprising: a housing and a circuit board assembly, the circuit board assembly comprising a circuit board, a processing chip, a gas detection probe and a controllable switcher;

wherein the circuit board is located in the housing; the processing chip, the gas detection probe and the controllable switcher are all mounted on the circuit board; the circuit board is limitedly connected or fixedly connected to the housing; and wherein the gas detection probe is electrically connected with the processing chip; the processing chip is configured to acquire target gas information in an environment through the gas detection probe; a control end of the controllable switcher is electrically connected to the processing chip; an output end of the controllable switcher is configured for electrical connection with an external device; and the processing chip is configured to control switching on or off of the controllable switcher at least according to the target gas information, thereby controlling change of an electrical signal of the external device;

wherein the number of the circuit board is at least one; the processing chip, the gas detection probe and the controllable switcher are all mounted on the same circuit board; the number of the controllable switchers is multiple, and the multiple controllable switchers are collectively arranged.

2. The control device according to claim 1, wherein the housing is provided with a ventilation hole; the circuit board has a first surface and a second surface which are located on different sides in a thickness direction of the circuit board; the first surface is closer to the ventilation hole than the second surface in the thickness direction of the circuit board; and the processing chip, the gas detection probe and the controllable switcher are all mounted on the first surface.

3. The control device according to claim 1, wherein the circuit board assembly further comprises at least one alarm element mounted on the circuit board, the alarm element is electrically connected to the processing chip, and the processing chip is configured to control the alarm element to emit sound and/or light warning information at least according to the target gas information.

4. The control device according to claim 1, wherein the circuit board assembly further comprises a function selector mounted on the circuit board, the number of the gas detection probes is at least two, the gas detection probe is selected from one of a thermal conductivity detection probe, an infrared detection probe and a semiconductor detection probe; the function selector is electrically connected to the processing chip, and the processing chip is configured for selectively electrically connecting with at least one of the gas detection probes according to the setting of the function selector.

5. The control device according to claim 1, wherein the at least one controllable switcher comprises one or more of a first relay for controlling switch-on and switch-off of an indoor fan of an air conditioning system, a second relay for controlling power-on or power-off of an indoor controller of the air conditioning system, a third relay for controlling power-on or power-off of an outdoor controller of the air conditioning system, a fourth relay for controlling switch-on or switch-off of a compressor, a fifth relay for controlling switch-on or switch-off of an indoor ventilation device, a sixth relay for controlling an on-off valve of the pipeline of the air conditioning system to turn on or off, a seventh relay for controlling a state of a reversing valve to switch between a cooling mode and a heating mode of the air conditioning system, and an eighth relay for controlling a remote alarm device to activate or deactivate an alarm.

6. The control device according to claim 1, wherein the circuit board assembly further comprises a wireless connection device interface mounted on the circuit board, one end of the wireless connection device interface is electrically connected with the processing chip, and another end is configured for electrical connection with a wireless connector; the processing chip is configured to instruct the wireless connector to wirelessly transmit an action instruction to a remote communicator according to at least the target gas information.

7. The control device according to claim 1, wherein the circuit board assembly further comprises a wired connection device interface mounted on the circuit board, one end of the wired connection device interface is electrically connected to the processing chip, and another end is configured to be electrically connected to a remote communicator through a signal transmission line; the processing chip is configured to instruct the remote communicator to act at least according to the target gas information.

8. The control device according to claim 2, wherein the housing comprises a first housing and a second housing, the first housing comprises a first housing wall and a first peripheral wall vertically extending from the first housing wall, the second housing comprises a second housing wall and a second peripheral wall vertically extending from the second housing wall, the first peripheral wall and the second peripheral wall are fixed;

the first housing wall and the second housing wall are located on different sides in the thickness direction of the circuit board, respectively; the ventilation hole is provided on the first housing wall; at least part of the gas detection probe is located between the ventilation hole and the circuit board, and a plurality of the controllable switchers are arranged in at least one row along a width direction of the circuit board.

9. The control device according to claim 8, wherein the first peripheral wall is provided with a wire harness fitting hole therethrough, the wire harness fitting hole is configured for passing a wire harness drawn from the output end of the controllable switcher;

the control device further comprises a connection terminal, the second housing is injection-molded with the connection terminal by using the connection terminal as an insert, the second housing has a plug portion extending outward from the second peripheral wall, the plug portion has a cavity, the connection terminal comprises a first end portion and a second end portion, the first end portion is connected to the circuit board, and the second end portion is located in the cavity.

10. The control device according to claim 9, wherein the controllable switcher is closer to the wire harness fitting hole than the gas detection probe along a length direction of the circuit board, and the gas detection probe is closer to the first end portion than the controllable switcher.

11. The control device according to claim 8, wherein the gas detection probe comprises an outer shell, a support seat, a first thermistor, a second thermistor and an inner shell, the inner shell is located in the outer shell and both the outer shell and the inner shell are welded with the support seat, a sealed space is formed between the inner shell and the support seat, an open space is formed between the outer shell, the inner shell and the support seat, the first thermistor is placed in the open space, and the second thermistor is placed in the sealed space.

12. The control device according to claim 11, wherein the housing has an inner cavity formed between the first housing and the second housing, a gas channel is provided through the outer shell, and the gas channel communicates with the open space and the inner cavity.

13. The control device according to claim 11, wherein the gas detection probe has a plurality of pins connected to the first thermistor or the second thermistor, the support seat is provided with a through hole, the pins protrude through the through hole of the support seat and are soldered to the circuit board.

14. The control device according to claim 1, further comprising a functional self-checking circuit arranged on the circuit board, and the functional self-checking circuit being electrically connected with the processing chip.

15. The control device according to claim 1, further comprising a storage unit provided on the circuit board, and the storage unit storing program instructions and being configured to communicate with the processing chip.

16. An air conditioner, comprising: an indoor unit and an outdoor unit, the indoor unit comprising an indoor heat exchanger, the outdoor unit comprising a compressor and an outdoor heat exchanger; wherein the air conditioner further comprises a control device mounted on the indoor unit;

wherein the control device comprises a housing and a circuit board assembly; the circuit board assembly comprises a circuit board, a processing chip, a gas detection probe and a controllable switcher;

wherein the circuit board is located in the housing; the processing chip, the gas detection probe and the controllable switcher are all mounted on the circuit board; the circuit board is limitedly connected or fixedly connected to the housing; and wherein the gas detection probe is electrically connected with the processing chip; the processing chip is configured to acquire target gas information in an environment through the gas detection probe; a control end of the controllable switcher is electrically connected to the processing chip; an output end of the controllable switcher is configured for electrical connection with an external device; and the processing chip is configured to control switching on or off of the controllable switcher at least according to the target gas information, thereby controlling change of an electrical signal of the external device.

17. The air conditioner according to claim 16, further comprising a throttle element, a liquid refrigerant shut-off valve provided between the throttle element and an inlet of the indoor heat exchanger, and a gaseous refrigerant shut-off valve provided between an outlet of the indoor heat exchanger and the compressor; wherein after the control device detects leakage of a refrigerant, the processing chip controls the gaseous refrigerant shut-off valve to turn on and the liquid refrigerant shut-off valve to shut off through the controllable switcher.

18. The air conditioner according to claim 16, wherein the air conditioner has a cooling mode and a heating mode, the air conditioner comprises a reversing valve which controls the air conditioner to switch between the cooling mode and the heating mode.

19. The control device according to claim 1, wherein the circuit board assembly comprises at least two circuit boards arranged separately, the at least two circuit boards are arranged side by side in the housing, the gas detection probe is mounted on one of the at least two circuit boards, and the controllable switcher is mounted on a remaining one of the at least two circuit boards.

20. A control device, comprising: a housing and a circuit board assembly, the circuit board assembly comprising a circuit board, a processing chip, a gas detection probe and a controllable switcher;

wherein the circuit board is located in the housing; the processing chip, the gas detection probe and the controllable switcher are all mounted on the circuit board; the circuit board is limitedly connected or fixedly connected to the housing; and wherein the gas detection probe is electrically connected with the processing chip; the processing chip is configured to acquire target gas information in an environment through the gas detection probe; a control end of the controllable switcher is electrically connected to the processing chip; an output end of the controllable switcher is configured for electrical connection with an external device; and the processing chip is configured to control switching on or off of the controllable switcher at least according to the target gas information, thereby controlling change of an electrical signal of the external device;

wherein the circuit board assembly comprises at least two circuit boards arranged separately, the at least two circuit boards are arranged side by side in the housing, the gas detection probe is mounted on one of the at least two circuit boards, and the controllable switcher is mounted on a remaining one of the at least two circuit boards.

* * * * *